United States Patent [19]

Hösel et al.

[11] Patent Number: 4,712,275

[45] Date of Patent: Dec. 15, 1987

[54] METHOD FOR DRIVING A BALE OPENER

[75] Inventors: Fritz Hösel, Mönchengladbach; Hans-Jürgen Marx; Josef Temburg, both of Jüchen, all of Fed. Rep. of Germany

[73] Assignee: Trützschler GmbH & Co. KG, Mönchengladbach, Fed. Rep. of Germany

[21] Appl. No.: 652,095

[22] Filed: Sep. 19, 1984

[30] Foreign Application Priority Data

Sep. 26, 1983 [DE] Fed. Rep. of Germany ..... 3334789

[51] Int. Cl.[4] ..... D01G 7/04

[52] U.S. Cl. ..... 19/80 R; 19/81

[58] Field of Search ..... 19/80 R, 81

[56] References Cited

U.S. PATENT DOCUMENTS 4,446,602 5/1984 Marx et al. ..... 19/81 X 4,514,881 5/1985 Hergeth et al. ..... 19/80 R

FOREIGN PATENT DOCUMENTS 2439520 3/1976 Fed. Rep. of Germany .

OTHER PUBLICATIONS

Promoli, "Mikroelektronik in der Spinnerelvorbereitung" Melliand Textilberichte, Jan. 1982, pp. 14–18.

*Primary Examiner*—Louis K. Rimrodt

*Attorney, Agent, or Firm*—Spencer & Frank

[57] ABSTRACT

A method of operating a bale opener, including the steps of propelling a carriage of the bale opener in a path of travel to execute consecutive back and forth passes in a generally horizontal direction along and between two parallel fiber bale rows having opposite end faces defining a length boundary for each bale row; removing, during each pass, fiber tufts from the top of the fiber bales of one of the rows by an opening device supported laterally by a tower mounted on the carriage; and turning, upon reaching the end of each pass, the tower through 180° about a generally vertical axis for swinging the opening device through 180° from above an end zone of one bale row to above an adjacent end zone of the other bale row such that the opening device, during its swinging motion, remains substantially in its entirety within the end boundary of at least one of the bale rows.

5 Claims, 15 Drawing Figures

FIG.5
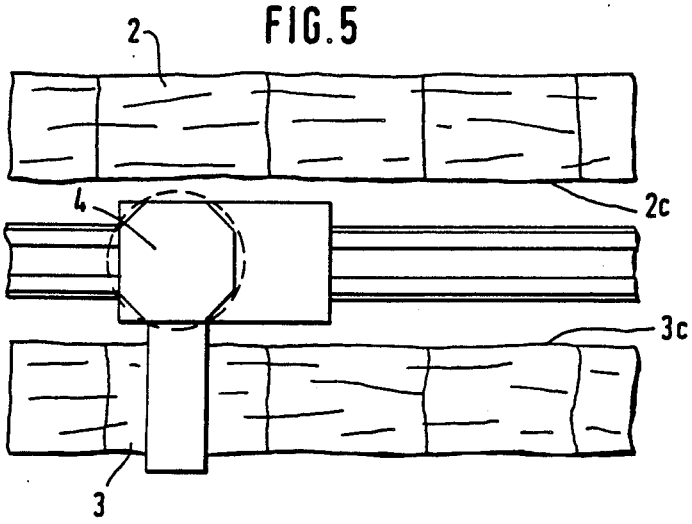
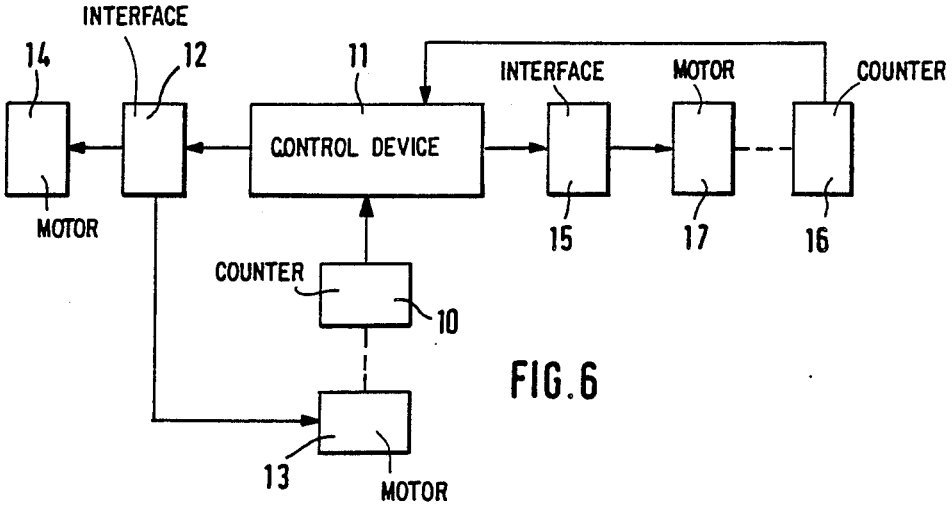
FIG.6

METHOD FOR DRIVING A BALE OPENER

BACKGROUND OF THE INVENTION

The invention relates to a method and an apparatus for operating a bale opener which removes fiber tufts from fiber bales composed of cotton, chemical fibers or the like. The bale opener has a back-and-forth traveling carriage on which a tower is mounted that supports, with the intermediary of a cantilever, an opening device such as rapidly rotating sawtooth discs or rolls. The carriage travels along and between two rows of free-standing fiber bales, and the opening device remove the fiber in layers from the top of the bales during the travel of the carriage and tower. Upon completion of a pass over a first bale row, the tower, together with the opening device, is rotated 180° about a vertical axis and performs a subsequent pass over a second fiber bale row arranged parallel to the first row along the opposite side of the carriage.

According to a known method, the carriage, with the tower and the opening device, upon completion of a pass over a first bale row, moves beyond the vertical end face (end boundary) thereof. Thereafter, the tower, with the opening device, is turned inwardly, that is, in the direction of the fiber bales, towards the parallel arranged second row for placing the opening device in position to start its working pass over the second bale row. The carriage, together with the tower and the opening device again moves beyond the vertical end face (end boundary) of the fiber bale row upon completion of the opening pass. Thereupon the tower with the opening device is turned outwardly, that is, in the direction away from the fiber bales, towards the first fiber bale row. The movement of the carriage beyond the length (end) boundaries of the fiber bale rows and the rotary motion of the opening device externally of the bale rows are disadvantageous for several reasons. Thus, for the linear travel and rotary motions of the tower and the opening device additional space is required which cannot be utilized for accommodating additional fiber bales. Further, such an increased operational space has to be ensured, for example, by means of optical barriers, guard chains or the like. Further, a turning motion of the opening device externally of the bale boundaries represents a significant safety risk.

SUMMARY OF THE INVENTION

It is an object of the invention to provide an improved method and apparatus for operating a traveling fiber bale opener, from which the discussed disadvantages are eliminated and which thus makes possible—at a given spatial availability for the motion and rotation of the carriage and the tower, respectively—the accommodation of a greater number of fiber bales.

These objects and others to become apparent as the specification progresses, are accomplished by the invention, according to which, briefly stated, the opening device, during its turning motion upon completion of an opening pass, does not project beyond the longitudinal end boundaries of at least one of the fiber bale rows.

By virtue of the fact that the opening device and the tower do not, during their turning motion, project beyond the end (frontal and rear) boundaries of the fiber bale row, it is feasible to arrange and process additional fiber bales while a certain space is provided for the turning motion of the tower and the opening device. The increased number of fiber bales thus does not require additional space for the linear and angular displacements of the bale opener. Further, no additional space is required for securing the working surface. By virtue of the fact that the horizontally extending cantilever of the tower is rotated vertically above the bale row rather than externally thereof, the risks of an accident are significantly reduced.

Preferably, the turning motion of the tower, together with the opening device, occurs in the same direction at both ends of the bale rows. It may, in certain cases, be advantageous to effect such a rotation in opposite directions at opposite ends of the bale opener in which case the opening device, at one of the two ends, travels backwardly through a distance which corresponds at least to the length of the opening device, plus a length representing a safety margin. After such rearward travel towards the opposite end of the bale rows, the tower, together with the opening device, is turned 180° and then the carriage is moved forward, back to its end position. Expediently, the traveling motion and the turning motion are performed simultaneously. In this manner, the time required for the traveling and turning motion is reduced to the period required solely for the turning motion.

The apparatus according to the invention comprises a driving device for effecting the traveling motion of the carriage and a driving device for effecting the rotary motion of the tower with the opening device. In the apparatus according to the invention a switching device, for example, a limit switch, is operatively coupled with the driving device for the carriage and a switching arrangement is provided for the energization and de-energization of the driving device for the rotary motion of the tower. Preferably, the switch for the driving device effecting the traveling motion of the carriage is electrically connected with the switch that energizes and de-energizes the driving device effecting the rotary motion of the tower.

According to a preferred embodiment of the invention, a counting device is, for the purpose of determining the position of the carriage, connected with a control apparatus to which there are also connected the driving device for the traveling motion of the carriage and the driving device for the rotary motion of the tower. Preferably, for determining the position of the carriage, there is provided a sensor which responds to stationary markings placed along the traveling path of the carriage. Expediently, the sensor is coupled with the control apparatus to which there are coupled the driving device for the traveling motion of the carriage and the driving device for the rotary motion of the tower.

According to a further feature of the invention, the tower has a circular or generally equilateral polygonal (preferably octagonal or hexagonal) cross-sectional outline. An eight-sided cross-sectional outline may also be obtained by beveling the corners of a rectanqular cross-sectional outline of the tower housing. By virtue of such cross-sectional configurations of the tower, it is feasible to rotate the tower in the intermediate space between the two fiber bale rows and thus, for the purpose of rotating the tower, the carriage need not travel beyond the end face of the bale row to ensure sufficient space for the rotary motion. Further, the bevelled edges prevent the tower from colliding with the lateral surfaces of the fiber bale rows.

BRIEF DESCRIPTION OF THE DRAWINGS

FIG. 5 is a schematic top plan view of a preferred embodiment of the apparatus according to the invention.

FIG. 6 is a block diagram of a system for controlling the motions of the apparatus according to the invention.

DESCRIPTION OF THE PREFERRED EMBODIMENTS

Figure 1:
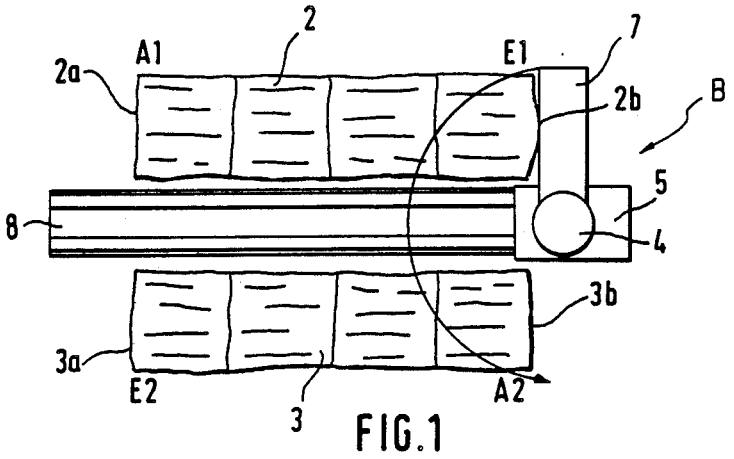
FIG. 1 is a schematic top plan view of an apparatus practicing a preferred embodiment and shown in an operational position at a first end of fiber bale rows.

Turning now to FIG. 1, there is schematically illustrated a traveling bale opener generally designated at B which may be a "BLENDOMAT" model manufactured by Trützschler GmbH & Co. KG, Mönchengladbach, Federal Republic of Germany. The bale opener B travels in a generally horizontal direction between two parallel extending fiber bale rows 2 and 3 for gradually removing fiber tufts from the top of the bales. The bale opener B has a tower 4 which is mounted on a carriage 5 for rotation thereon about a generally vertical axis. As illustrated in FIG. 7*b*, the carriage 5 is provided with wheels 6*a* and 6*b* which expediently run on rails. From one side of the tower 4 there projects a vertically displaceable cantilever, from the underside of which there projects an opening device, such as rapidly rotating sawtoothed rolls. The cantilever and the opening device are illustrated only symbolically with a rectangle and designated at 7. The opening device 7 removes fiber tufts from the top face of the fiber bales of the bale rows 2 and 3. Underneath the tower 4 there extends a duct 8 which receives the fiber tufts from the tower 4 and through which the fiber tufts are removed, for example, by an air stream.

During operation, the carriage 5, together with the tower 4 travels along and between the free-standing fiber bale rows 2 and 3. Starting, for example, from an initial position A1 of the bale row 2, the carriage 5 travels to the end E1 of the bale row 2 (forward travel). As seen in FIG. 1, at the location E1 the tower 4 and the opening device 7 are, as a unit, rotated through an angle of 180° about a vertical axis in a counterclockwise direction as illustrated by the arcuate arrow. In this manner, the opening device 7 is placed into an operative position at location A2 which designates the beginning of the fiber bale row 3. Thereafter, the carriage 5 travels to the end E2 of the bale row 3 (return travel).

Figure 2:
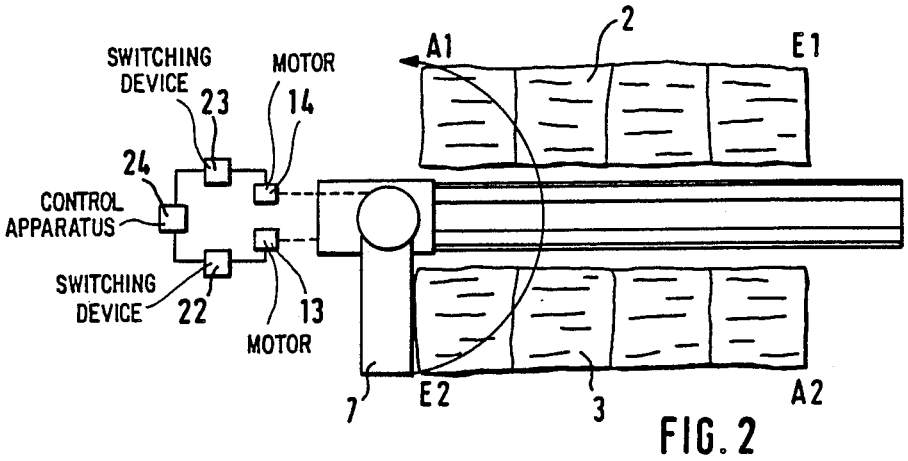
FIG. 2 is a schematic top plan view similar to FIG. 1, illustrating an operational position at another, opposite end of the fiber bale rows, and including a block diagram of an apparatus control.

Turning now to FIG. 2, according to a first embodiment of the invention, the tower 4 and the opening device 7 are, at the location E2, rotated through an angle of 180° about a vertical axis in a counterclockwise direction as indicated by the arcuate arrow. Stated differently, at the start of the turning motion of the tower 4 and the opening device 7, the direction of such motion is oriented opposite the traveling direction of the carriage during the just-completed pass. As a result, the opening device 7 assumes its operational position again at the location A1 of the fiber bale row 2. Thereafter, the operational cycle as described above is repeated. In the zone A1/E2 as well as in the zone E1/A2, the opening device 7, during its turning motion about the vertical axis does not project beyond the end faces 2*a*, 3*a* and 2*b*, 3*b* of the respective bale rows 2 and 3. The opening device 7 swings inwardly in the direction of the bales 2 and 3. For an electrical power and signal transmission to the tower 4, for example, to the driving device for the height adjustment of the opening device 7 expediently sliding contacts are used.

As further seen in FIG. 2, there is provided a switching device 22 which is coupled with a driving device (motor) 13 for effecting the travel of the carriage 5 and further, there is provided a switching device 23 for the energization and de-energization of a driving device (motor) 14 which effects the turning motion of the tower 4 about a vertical axis. The switching device 22 is electrically connected with the switching device 23 with the intermediary of a control apparatus 24.

Starting with the turning motion in the zone E1/A2 according to FIG. 1, FIGS. 3*a* through 3*e* show another embodiment of the method of turning the tower 4 in the location E2/A1. As will be described below, in this location the bale opener executes a dual motion for positioning the opening device 7 from the location E2 to the location A1.

Figure 3A:
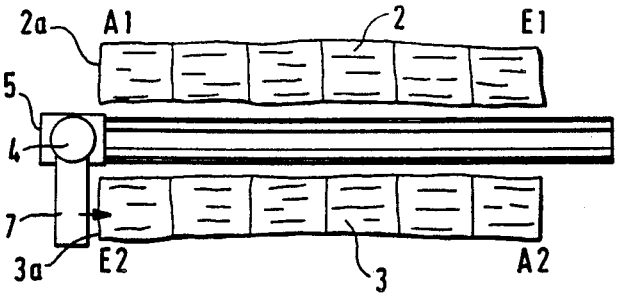
FIGS. 3*a* through 3*e* are schematic top plan views of an apparatus practicing another preferred embodiment and showing positions in successive operational phases.
Figure 3B:
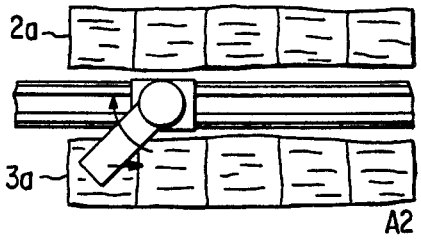
Figure 3C:
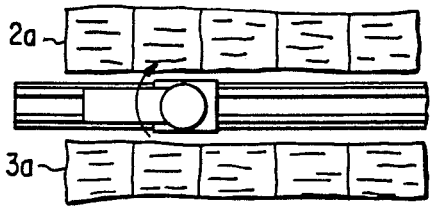
Figure 3D:
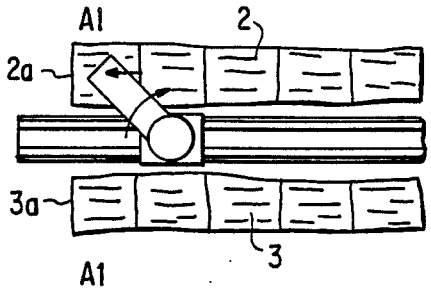
Figure 3E:
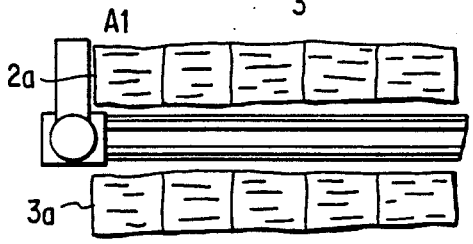

Starting from the position shown in FIG. 3*a*, the carriage 5 is displaced in the direction A2 of the bale row 3 as shown in FIG. 3*b* and, simultaneously, the tower 4, together with the opening device 7, rotates in a clockwise direction. As shown in FIG. 3*c*, the carriage 5 has reached its end position at which time the travelled path of the carriage 5 approximately corresponds to the length of the opening device (and cantilever) 7. Thereupon, as shown in FIG. 3*d*, the carriage 5 travels towards the location A1 at which time the opening device 7 has already swung, in the course of its clockwise turning motion, above the bale row 2. FIG. 3*e* shows the terminal position of the bale opener at location A1. By displacing the carriage 5 as well as the tower 4 and the opening device 7 in this manner, the opening device, during the turning motion, does not project beyond the end faces 2*a* and 3*a* of the respective bale rows 2 and 3. In this embodiment, for the electrical power and signal transmission to the tower 4 expediently cables are used. Since the rotation of the tower 4 with the opening device 7 in both zones A1/E2 and E1/A2 occur in opposite rotary directions, the cables are reeled on a winch device in the one turning direction and paid out from the winch device when the tower turns in the other direction.

Figure 4A:
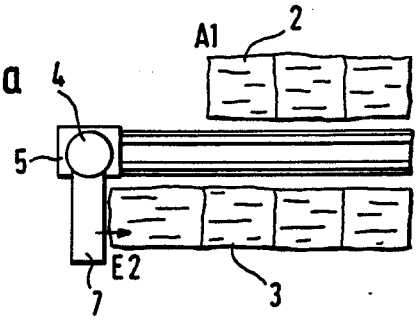
FIGS. 4*a* through 4*c* are schematic top plan views of an apparatus practicing still another preferred embodiment and showing positions in consecutive operational phases in case of two parallel bale rows of different lengths.
Figure 4B:
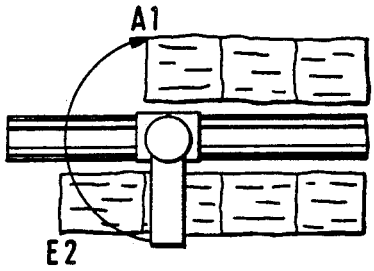
Figure 4C:
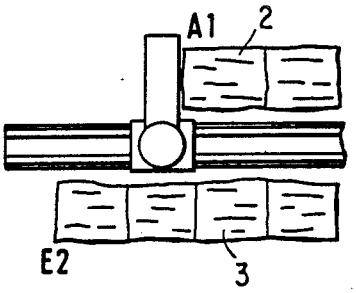

Turning now to FIGS. 4*a*, 4*b* and 4*c*, there are illustrated two fiber bale rows 2 and 3 which, for example, because of the different number of fiber bales therein, have different lengths. The carriage 5 travels from the end zone E2 of the bale row 3 in the direction of the starting zone A2 (not shown) thereof. Thereafter the tower 4, together with the opening device 7 is rotated in a clockwise direction. As a result, the opening device 7 will be positioned in the initial zone A1 of the bale row 2.

Turning now to FIG. 5, the tower 4 has an octagonal cross-sectional outline. The circle shown circumscribed in phantom lines about the octagonal cross section of the tower 4 illustrates that the tower may be rotated about a vertical axis between the fiber bale rows 2 and 3 without touching the side faces 2*c* or 3*c* thereof.

Turning now to FIG. 6, for determining the position of the carriage 5 there is used a counter 10 which is connected with a control device 11, such as a microcomputer including a microprocessor. To the control device 11 there is connected, with the intermediary of an interface 12, the driving device (drive motor) 13 for propelling the carriage 5 and the driving device (drive motor) 14 of the gearing (not illustrated) for turning the tower 4. The counter 10 is driven by the drive motor 13 by means of, for example, a mechanical coupling symbolically illustrated by a broken line. To the control device 11 there is further coupled, by means of an interface 15, a counter 17 which is driven by the drive motor 16 by means of, for example, a mechanical clutch. The drive motor 16 effects the height adjustment of the opening device 7. The counting system informs the control device 11 of the exact position of the carriage 5 at each point in time. In the control device 11 there are stored the geometrical initial positions A1 and A2 and the end positions E1 and E2 of the two bale rows 2 and 3. If, for example, as shown in FIG. 3*a*, the end zone E2 is reached, the control device computes how far the carriage 5 should travel in the direction of the location A2 to ensure that the opening device 7 may be turned without projecting beyond the end faces 2*a*, 3*a* of the respective fiber bale rows 2 and 3.

Figure 7A:
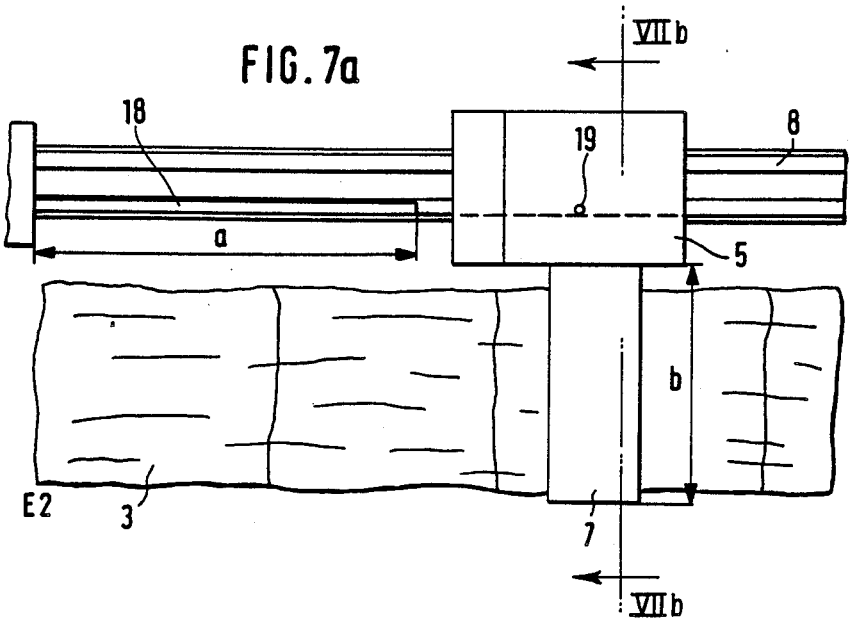
FIG. 7*a* is a schematic top plan view illustrating additional features of the apparatus shown in FIG. 1.
Figure 7B:
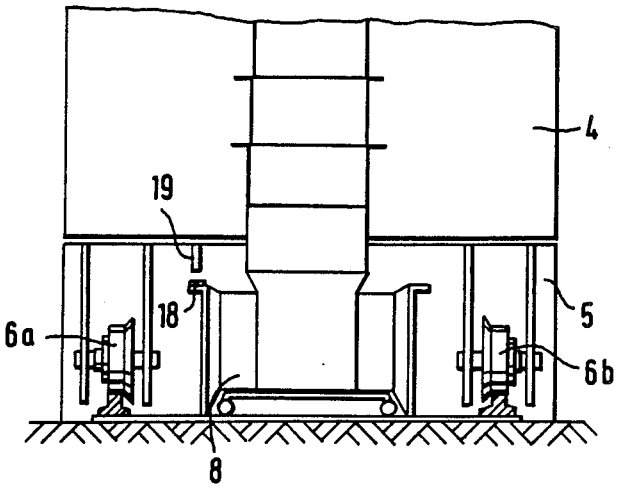
FIG. 7*b* is a fragmentary schematic sectional view taken along line VIIb—VIIb of FIG. 7*a*.
Figure 8:
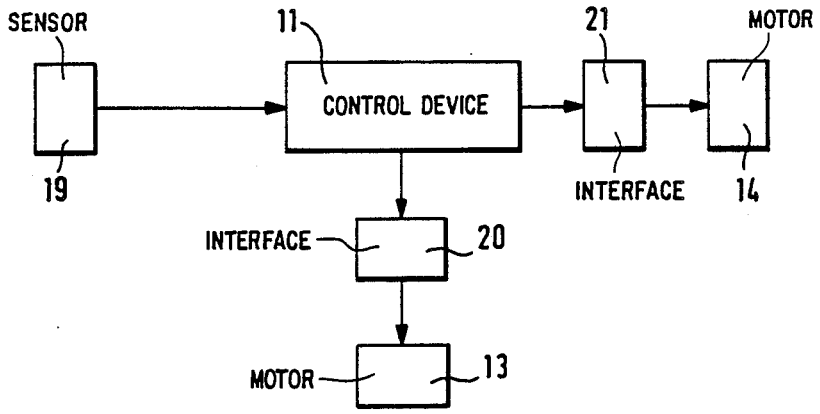
FIG. 8 is a block diagram of a modified system for controlling the motions of the apparatus according to the invention.

Turning now to FIG. 7*a*, there is illustrated the tuft guiding duct 8 on the upper side of which, in the zone E2, there is provided a metal strip 18, extending along the traveling path of the carriage 5 and serving as a marking. The length a of the metal strip 18 corresponds to the length b of the opening device 7, plus a distance representing a safety margin. On the carriage 5 there is mounted a sensor 19, for example, an inductive proximity switch which responds to the presence of the marking 18 and transmits a corresponding electrical signal to the control device 11, as shown in FIG. 8. FIG. 7*b* illustrates the structural relationship of the sensor 19 to the metal strip 18 mounted along the upper edge zone of the duct 8. The sensor 19, in cooperation with the metal strip 18, makes possible the determination of the position of the carriage 5 during its travel. The sensor system informs the control device 11 about the location of the carriage 5 in the zone E2/A1 of the respective bale rows 2 and 3. The control device 11 constitutes a coupling between the drive motor 13 for the carriage 5 and the drive motor 14 for the turning motion of the tower 4. Thus, the control device 11 coordinates the traveling motion of the carriage 5 and the turning motion of the tower 4.

Reverting once again to FIG. 8, the sensor 19 is connected to a control device 11 which may be, for example, a microcomputer including a microprocessor. The control device 11 is connected with the drive motor 13 of the carriage 5 with the intermediary of an interface 20. Further, the control device 11 is connected with the drive motor 14 effecting the turning motion of the tower 4 by means of an interface 21. The system shown in FIG. 8 thus determines how far away from the end zone E2 the carriage 5 has to be moved to ensure that the opening device 7 does not project beyond the end faces 2*a* and 3*a* of the respective bale rows 2 and 3.

The microcomputer constituting the control apparatus 11 may be, for example, a Trützschler model TMS (including a microprocessor 6502 Rockwell), manufactured by Trützschler GmbH & Co. KG, Mönchengladbach, Federal Republic of Germany.

It will be understood that the above description of the present invention is susceptible to various modifications, changes and adaptations, and the same are intended to be comprehended within the meaning and range of equivalents of the appended claims.

What is claimed is:

1. In a method of operating a bale opener, including the steps of propelling a carriage of the bale opener in a path of travel to execute consecutive back and forth passes in a generally horizontal direction along and between two parallel fiber bale rows having opposite end faces defining a length boundary for each bale row; removing, during each pass, fiber tufts from the top of the fiber bales of one of the rows by an opening device suported laterally by a tower mounted on the carriage; the improvement comprising the step of turning, upon reaching the end of each pass, the tower through 180° about a generally vertical axis for swinging the opening device through 180° from above an end zone of one bale row to above an adjacent end zone of the other bale row such that the opening device, during its swinging motion, remains substantially in its entirety within the end boundary of at least one of the bale rows.

2. A method as defined in claim 1, wherein the step of turning the tower comprises the step of turning the tower in the same sense at opposite end zones of the bale rows.

3. A method as defined in claim 1, wherein the step of turning the tower comprises the step of turning the tower in opposite directions at opposite end zones of the bale rows; further comprising the steps of backing up the carriage, upon completion of a pass, at a first end zone of the bale rows towards an opposite, second end zone thereof, through a distance which corresponds at least to the horizontal length dimension of the opening device; returning the carriage through said distance to said first end zone and performing said turning step while said carriage is at a distance from said first end zone as a result of the step of backing up said carriage.

4. A method as defined in claim 3, wherein the steps of backing up the carriage and turning the tower are performed simultaneously.

5. A method as defined in claim 1, wherein a starting direction of the swinging motion of said opening device is oriented opposite the direction of the pass just completed by the carriage.

* * * * *